US005210514A

United States Patent [19]

Ito et al.

[11] Patent Number: 5,210,514

[45] Date of Patent: May 11, 1993

[54] COIL DEVICE

[75] Inventors: Shinichiro Ito; Yukiharu Kinoshita, both of Tokyo, Japan

[73] Assignee: TDK Corporation, Tokyo, Japan

[21] Appl. No.: 954,428

[22] Filed: Sep. 30, 1992

Related U.S. Application Data

[63] Continuation of Ser. No. 572,277, Aug. 24, 1990, abandoned.

[51] Int. Cl.[5] ..... H01F 17/06

[52] U.S. Cl. ..... 336/178

[58] Field of Search ..... 335/281, 296, 297; 336/83, 134, 165, 178, 212

[56] References Cited

U.S. PATENT DOCUMENTS

| | | | |
|---|---|---|---|
| 2,777,099 | 1/1957 | Foss et al. | 335/297 |
| 2,825,849 | 3/1958 | Lufkin | 336/178 |
| 3,143,686 | 8/1964 | Vonderschmitt | 336/178 |
| 3,434,085 | 3/1969 | Gang | 335/297 |
| 3,761,853 | 9/1973 | Schutz et al. | 336/84 |
| 4,042,898 | 8/1977 | Tomita et al. | 335/297 |
| 4,356,468 | 10/1982 | van Laar | 336/178 X |
| 4,870,380 | 9/1989 | McGinley | 335/297 |

FOREIGN PATENT DOCUMENTS

| | | | |
|---|---|---|---|
| 2203210 | 1/1972 | Fed. Rep. of Germany . | |
| 3123006 | 10/1981 | Fed. Rep. of Germany . | |
| 0225830 | 12/1985 | France . | |
| 52-32923 | 7/1977 | Japan . | |
| 55-32097 | 3/1980 | Japan . | |
| 55-16457 | 4/1980 | Japan . | |
| 55-77115 | 6/1980 | Japan . | |
| 55-107215 | 8/1980 | Japan . | |
| 55-179013 | 12/1980 | Japan . | |
| 57-31113 | 2/1982 | Japan . | |
| 57-130402 | 8/1982 | Japan . | |
| 58-20514 | 2/1983 | Japan . | |
| 60-163719 | 10/1985 | Japan . | |
| 62-91418 | 6/1987 | Japan . | |
| 62-180921 | 11/1987 | Japan . | |
| 63-44974 | 11/1988 | Japan . | |
| 1027685 | 4/1966 | United Kingdom | 336/178 |
| 1341038 | 12/1973 | United Kingdom | 336/178 |

*Primary Examiner*—Leo P. Picard
*Assistant Examiner*—R. Barrera
*Attorney, Agent, or Firm*—Nikaido, Marmelstein, Murray & Oram

[57] ABSTRACT

A coil device includes two magnetic cores each having a U-shape in section forming a closed magnetic path therein with their legs being opposed to each other and having a gap in such path, and a coil wound so as to cover the gap. In this structure, the mutually opposed portions of the magnetic cores in the region to form the gap are so shaped that the cross-sectional area of the fore end becomes smaller than that of the base end, thereby preventing concentration of any leakage magnetic flux on the gap portions while averting abnormal generation of heat in the coil to consequently eliminate harmful influence of noise on peripheral apparatus or components.

8 Claims, 9 Drawing Sheets

COIL DEVICE

This application is a continuation of application Ser. No. 07/572,277 filed Aug. 24, 1990 is now abandoned.

BACKGROUND OF THE INVENTION

1. Field of the Invention

The present invention relates to improvement in a coil device for use in a flyback transformer, a switching power transformer, a choke coil or the like. And more particularly, it relates to improvements in a coil device employing a magnetic core with a gap.

2. Description of the Prior Art

In any of the conventional transformers, choke coils and so forth known heretofore, it is customary to form a gap in a closed magnetic path so that the magnetic core thereof is not saturated when a desired current is caused to flow. For example, when a ferrite magnetic core usually having a magnetic permeability $\mu$ of 5000 or so is used in a transformer, a gap (hereinafter referred simply to as gap) is formed therein to reduce the effective permeability $\mu$ within a range of 50 to 300.

This signifies that a gap having a great magnetic reluctance needs to exist in a ferrite magnetic core of which magnetic reluctance is originally small, whereby a greater leakage flux is generated in the periphery of the gap.

It is generally known that such leakage flux exerts at least two harmful influences as follows:

(1) Noise is induced in peripheral apparatus (components) which are prone to be affected by magnetic induction.

(2) In case the coil is so wound as to surround the gap, there occurs an abnormal generation of heat in the coil around the gap due to the leakage flux.

For the purpose of solving the above problems, a variety of improvements have been developed.

In an attempt to settle the problem (1), an exemplary method has been developed for forming a gap merely in the coil alone. However, such method brings about another fault that worsens the problem (2) on the contrary.

With regard to the problem (2), some prior examples are known as disclosed in Japanese Patent Laid-open No. 55 (1980)-77115 and Utility Model Laid-open No. 57 (1982)-130402, wherein a gap positioned in a coil is divided magnetically into a plurality of serial portions so as to disperse the concentration of leakage flux. In the prior means developed for solving the problems (1) and (2), there are known examples as disclosed in Japanese Utility Model Publication Nos. 53 (1978)-53850 and 60 (1985)-7448, wherein a gap filler, of which relative permeability is greater than that of air (greater than 1), is used to reduce the magnetic reluctance in the gap portion so as to diminish the leakage flux.

When such gap filler of a material having a greater relative permeability than that of air (greater than 1) is disposed inside of a coil, there exists a possibility that the problems (1) and (2) can be solved to some extent.

However, even in such an improved structure, another problem is still left unsettled that the leakage flux is concentrated on the boundary between the gap and the magnetic core, and in addition a new problem also arises with regard to difficulty in obtaining a satisfactory material which has an adequate permeability as a gap filler while still retaining a high saturation flux density and low core loss characteristic equivalent to that of the magnetic core. Consequently, some disadvantages are unavoidable including that the coil wound on the boundary between the gap and the magnetic core is heated to an abnormal extent, and the gap portion is also heated excessively due to the core loss of the gap filler material, and further the B-H curve of the magnetic core with the gap filler inserted therein is rendered nonlinear to eventually cause wave for distortion when the coil device is used in a transformer. Thus, in the current technical stage, completely effective improvements are not available.

OBJECTS AND SUMMARY OF THE INVENTION

It is therefore an object of the present invention to solve the above problems and provide an improved coil device which is capable of minimizing the harmful influence of noise to peripheral apparatus (components) and diminishing any leakage flux generated in the periphery of a gap to consequently prevent abnormal generation of heat in the coil around the gap.

And another object of the present invention resides in providing an improved coil device which realizes lower production cost and enhanced reliability.

For the purpose of achieving the objects mentioned, some alterations have been accomplished in a coil device comprising two magnetic cores each having U-shape in section which form a closed magnetic path therein with their legs being opposed to each other and having a gap in such a path, and a coil wound so as to cover the gap. And the feature of the present invention resides in a structure where the mutually opposed portions of the magnetic cores in the region forming the gap are so shaped that the cross-sectional area of the fore end becomes smaller than the cross-sectional area of the base end.

Furthermore, with regard to the magnetic core portions in the region to form the gap, the rate of the cross-sectional area of the fore end to that of the base end is defined to be within a range of 1 to 90 percent.

Other features reside in that the fore end is shaped with curves defined by logarithmic functions, and a planar member is provided on the fore end, or projections are formed on the face of the fore end.

Due to the constitution mentioned, there occurs no concentration of any leakage flux between the gap and the core end faces, and since no gap filler is used, any core loss is not induced to consequently achieve the above objects.

DESCRIPTION OF THE PREFERRED EMBODIMENTS

Figure 1:
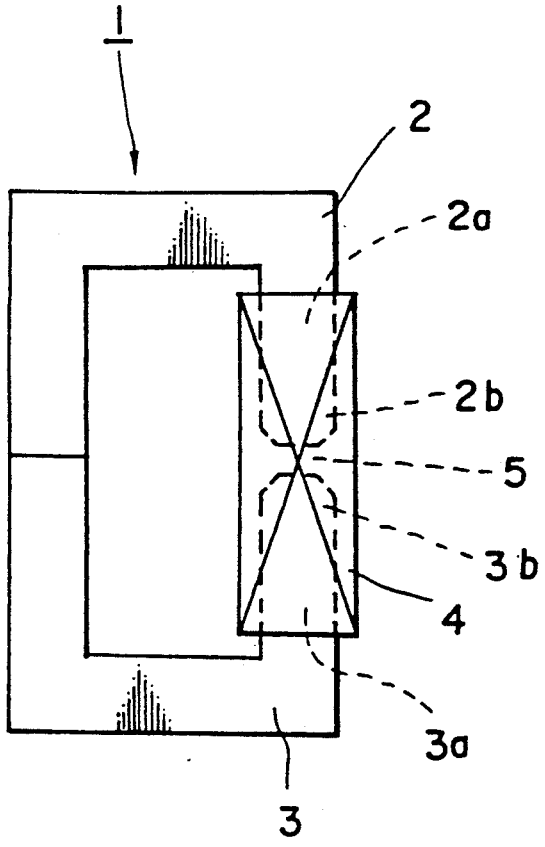
FIG. 1 schematically shows an exemplary embodiment of the coil device according to the present invention.

A coil device 1 shown in FIG. 1 comprises two sectionally U-shaped magnetic cores 2, 3 of which fore ends abut to each other, wherein a gap 5 is formed between opposed faces of one-side legs 2*a*, 3*a* and a coil 4 is wound thereon.

Figure 26:
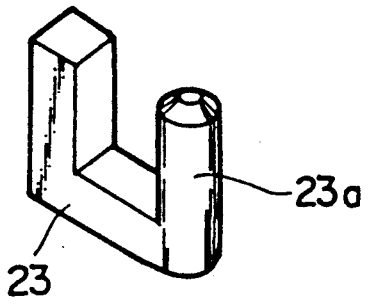
FIGS. 26 and 27 are perspective views illustrating further modified shapes of the magnetic core used in the coil device of the invention.
Figure 27:
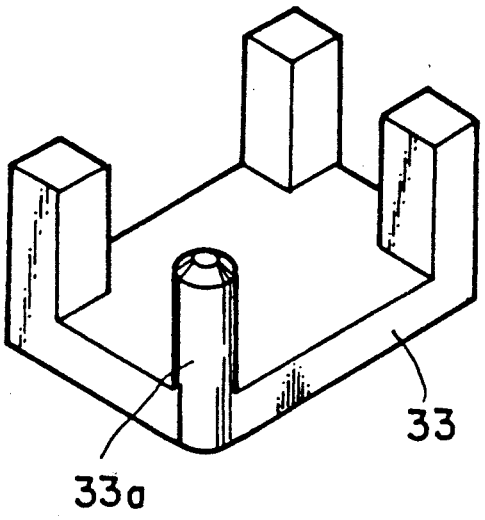

Some examples of such sectionally U-shaped magnetic cores are illustrated in FIGS. 26 and 27. In the example of FIG. 26, a rectangular core 23 is shaped into U, and its one-side leg 23*a* is shaped to be columnar. The text example of FIG. 27 is a magnetic core 33 having four legs, one of which legs is a columnar leg 33*a*. In the actual coil device, a pair of such cores are combined with each other and a coil is wound on the columnar legs thereof, although merely a single core is illustrated in each of the above diagrams. And such core is composed of ferrite material.

Referring now to the accompanying drawings, the characteristic and the structure of an embodiment of the present invention will be described in comparison with that of a conventional example.

Figure 2:
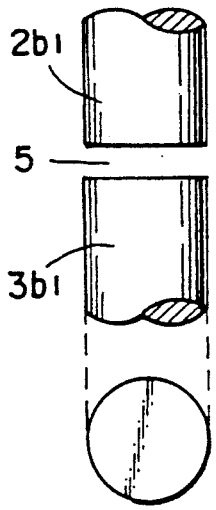
FIG. 2 is a schematic diagram illustrating the shape of a gap portion in a magnetic core used in a conventional coil device.

FIG. 2 illustrates the shape of gap portions in magnetic cores used in a conventional coil device, wherein the shapes of mutually opposed ends 2*b* and 3*b* of the magnetic cores and the gap width thereof are so determined that the effective permeability of the magnetic core is rendered uniform in the entirety. The opposed ends $2b_1$ and $3b_1$ of the magnetic cores in the conventional coil device of FIG. 2 are shaped to be columnar in a manner that the sectional areas thereof remain unchanged. And the gap has a width of 3 mm.

Figure 3:
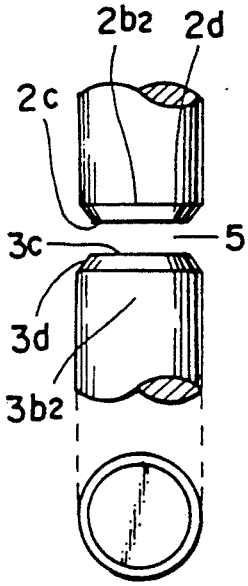
FIGS. 3 through 7 are schematic diagrams illustrating the shapes of gap portions in magnetic cores used in the coil device of FIG. 1.
Figure 4:
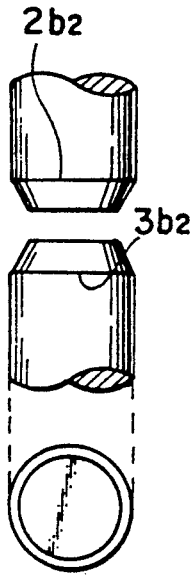
Figure 5:
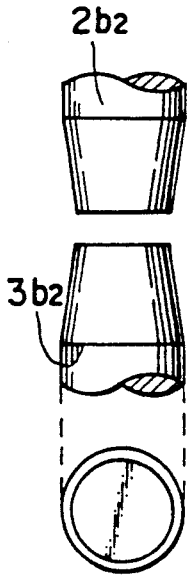
Figure 6:
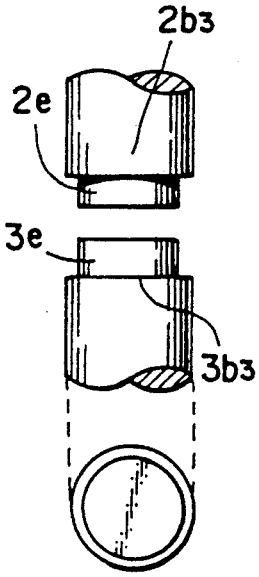
Figure 7:
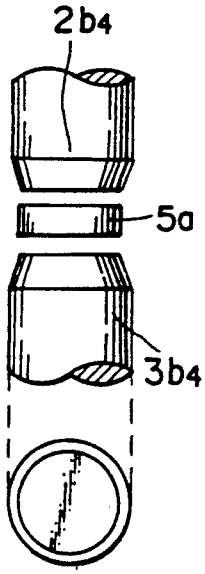

In the exemplary magnetic cores of the present invention shown in FIGS. 3, 4 and 5, opposed ends $2b_2$, $3b_2$ are so shaped that the sectional areas thereof are reduced by tapered portions 2*d*, 3*d* toward opposed faces 2*c*, 3*c*, and the gap 5 is formed to have a width of 2.5 mm in FIG. 3, 2.0 mm in FIG. 4, and 1.8 mm in FIG. 5 respectively so that the effective permeability $\mu$ becomes uniform. In further examples, opposed ends $2b_3$, $3b_3$ of FIG. 6 are so formed that the sectional areas thereof are reduced by stepped projections 2*e*, 3*e*; and opposed ends $2b_4$, $3b_4$ of FIG. 7 are so formed that the sectional areas thereof are reduced, and a core member 5*a* identical in material with the magnetic cores is inserted there between while being held in a gap filler (not shown) which exerts no harmful influence on the magnetic permeability $\mu$.

Figure 8:
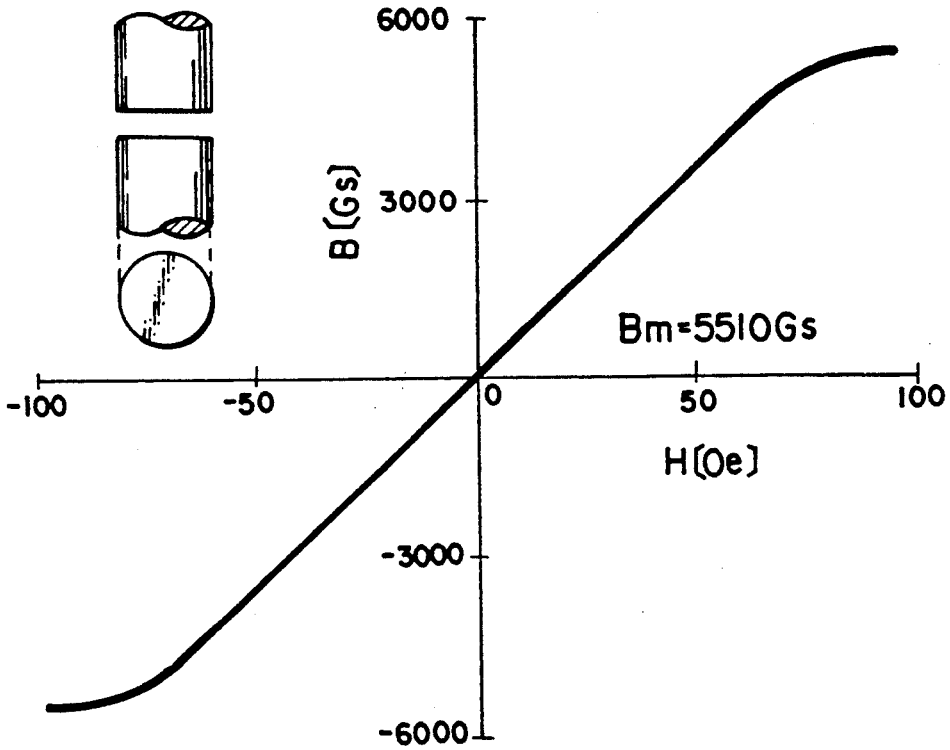
FIG. 8 graphically represents a B-H curved in the convention coil device using magnetic core with the gap shown in FIG. 2.
Figure 9:
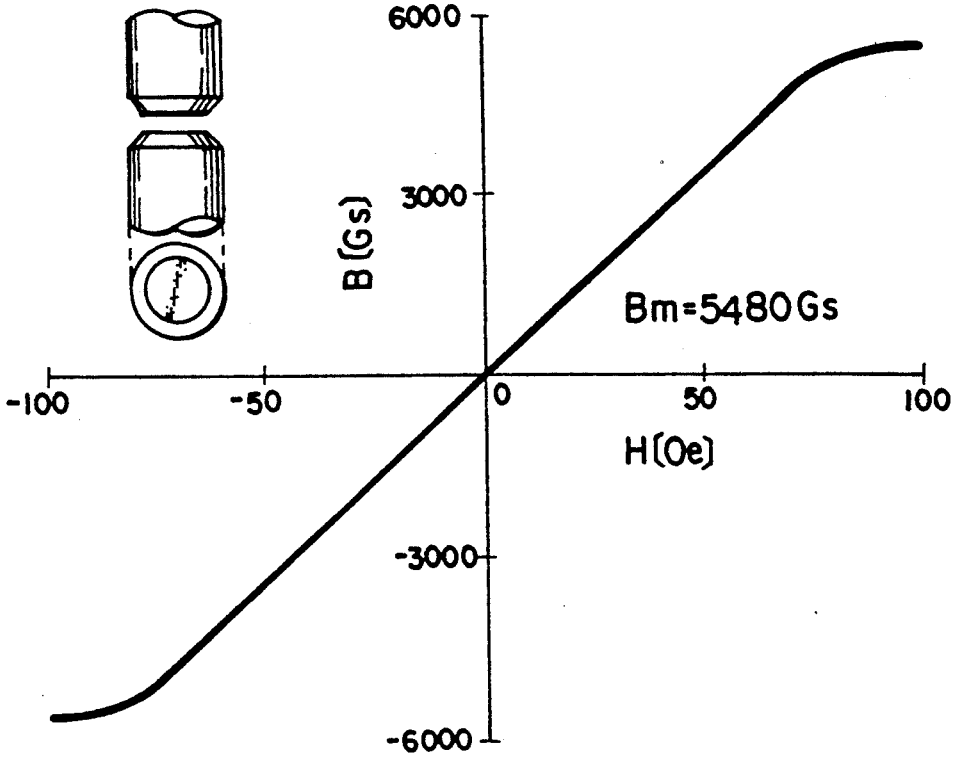
FIGS. 9 through 13 graphically represent B-H curves in coil devices using magnetic cores with the gaps shown in FIGS. 3 through 7.
Figure 10:
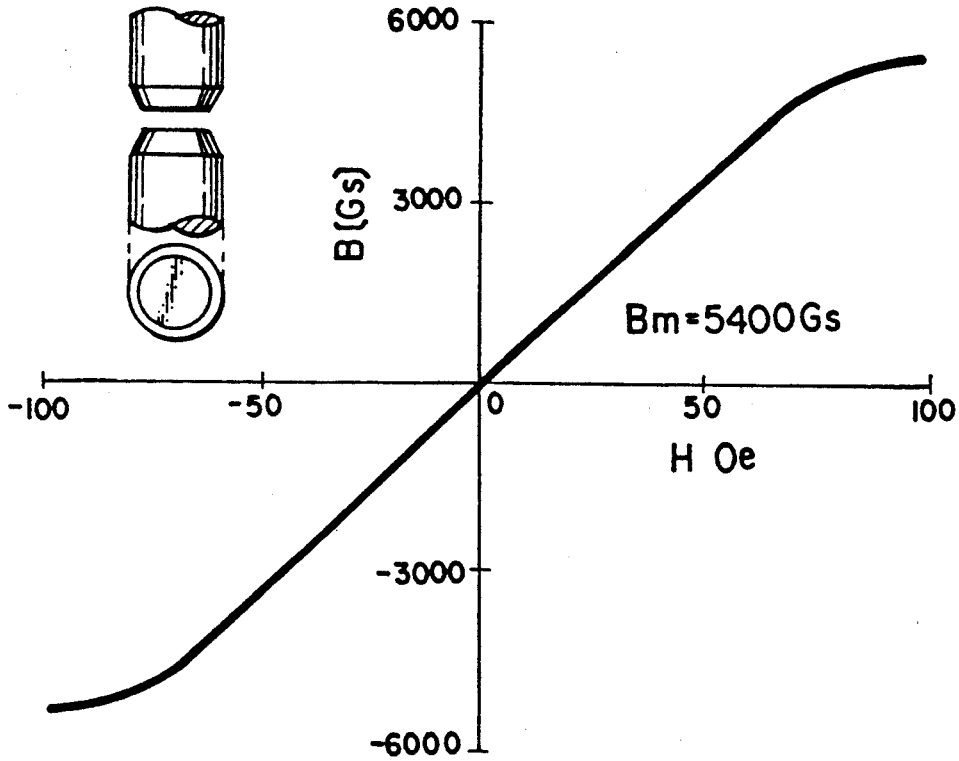
Figure 11:
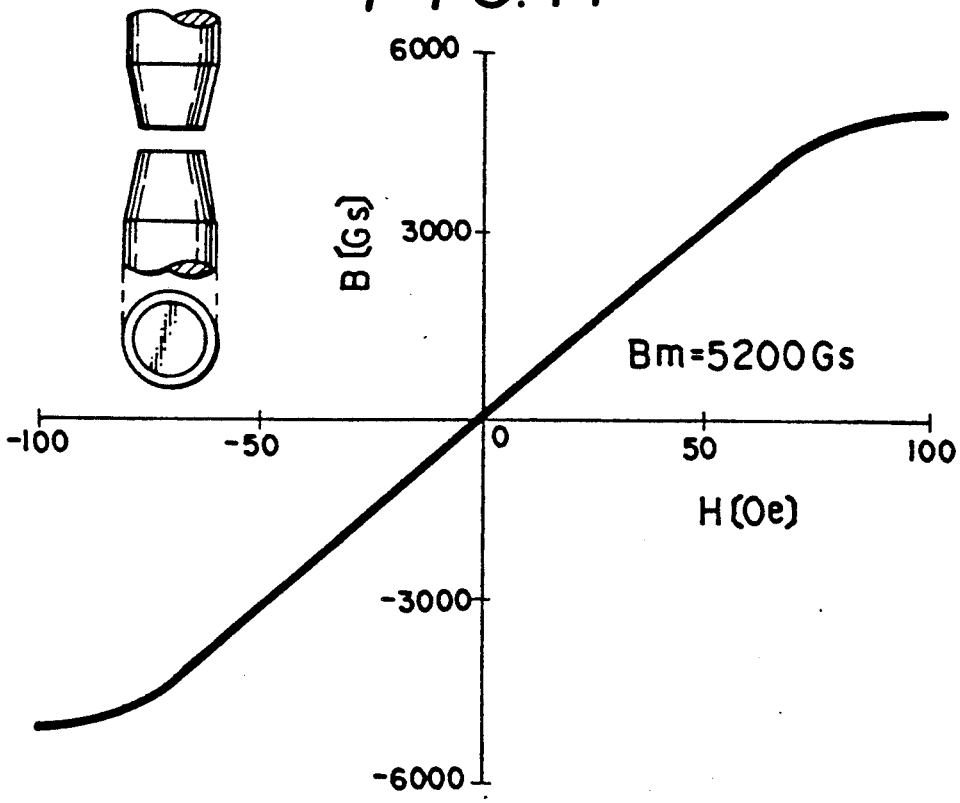
Figure 12:
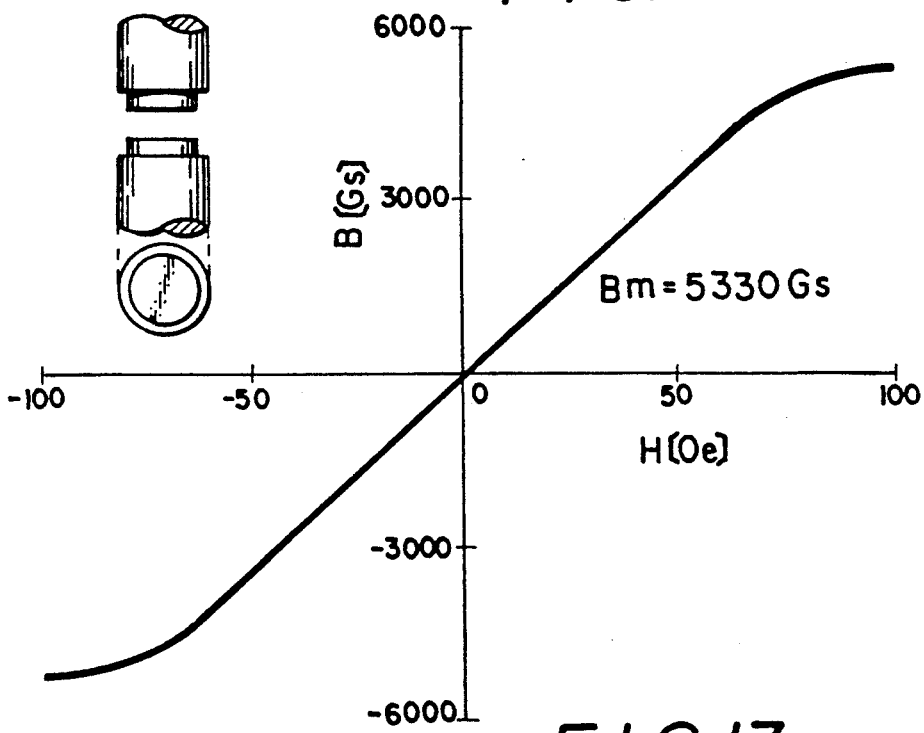
Figure 13:
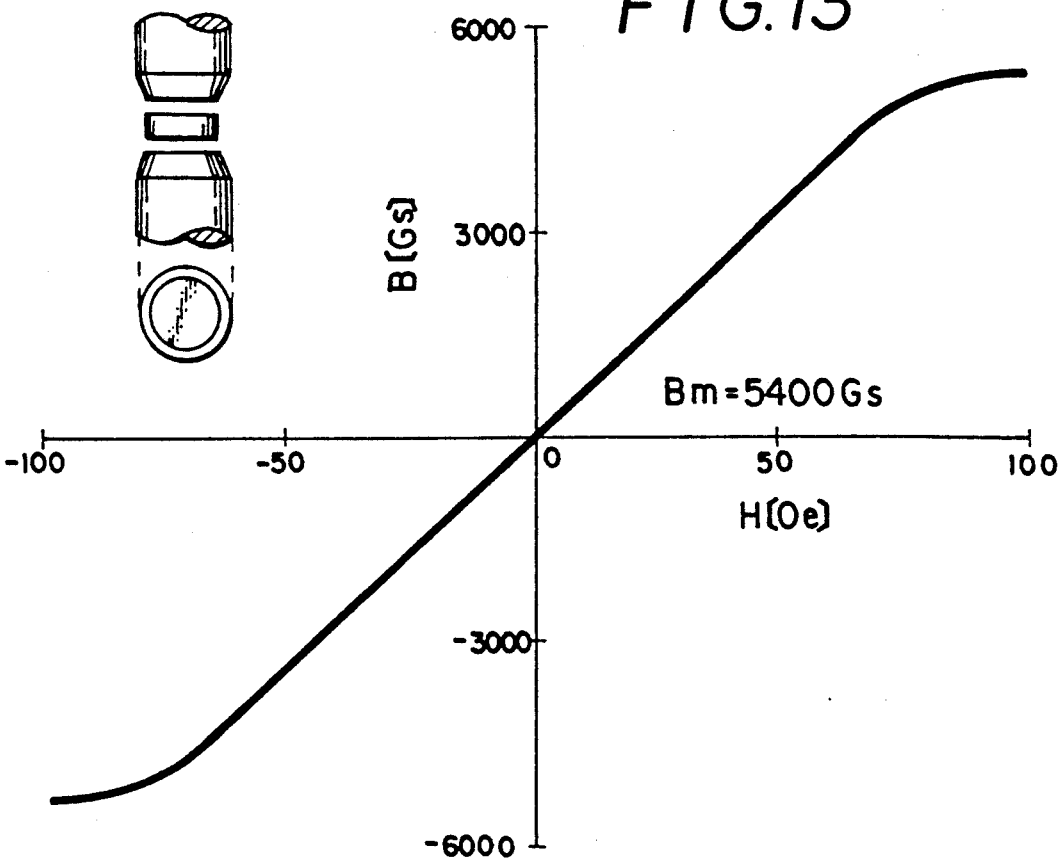

FIG. 8 graphically represents a B-H curve obtained in a conventional coil device using magnetic cores of the shape shown in FIG. 2; and FIGS. 9 through 13 graphically represent B-H curves in coil devices using magnetic cores of the shapes shown in FIGS. 3 through 7, respectively. Comparing such curves with one another, the saturation magnetic flux density Bm in the conventional coil device with opposed ends of the known shape shown in FIG. 8 is 5510 Gs; whereas in the coil devices of the present invention using magnetic cores of the shapes shown in FIGS. 9, 10, 11, 12 and 13, the saturation magnetic flux densities are 5480, 5400, 5200, 5330 and 5400 Gs, respectively. It is also found that the linearity in the latter is not changed, although each density thereof is slightly lower than that in FIG. 8.

Figure 14:
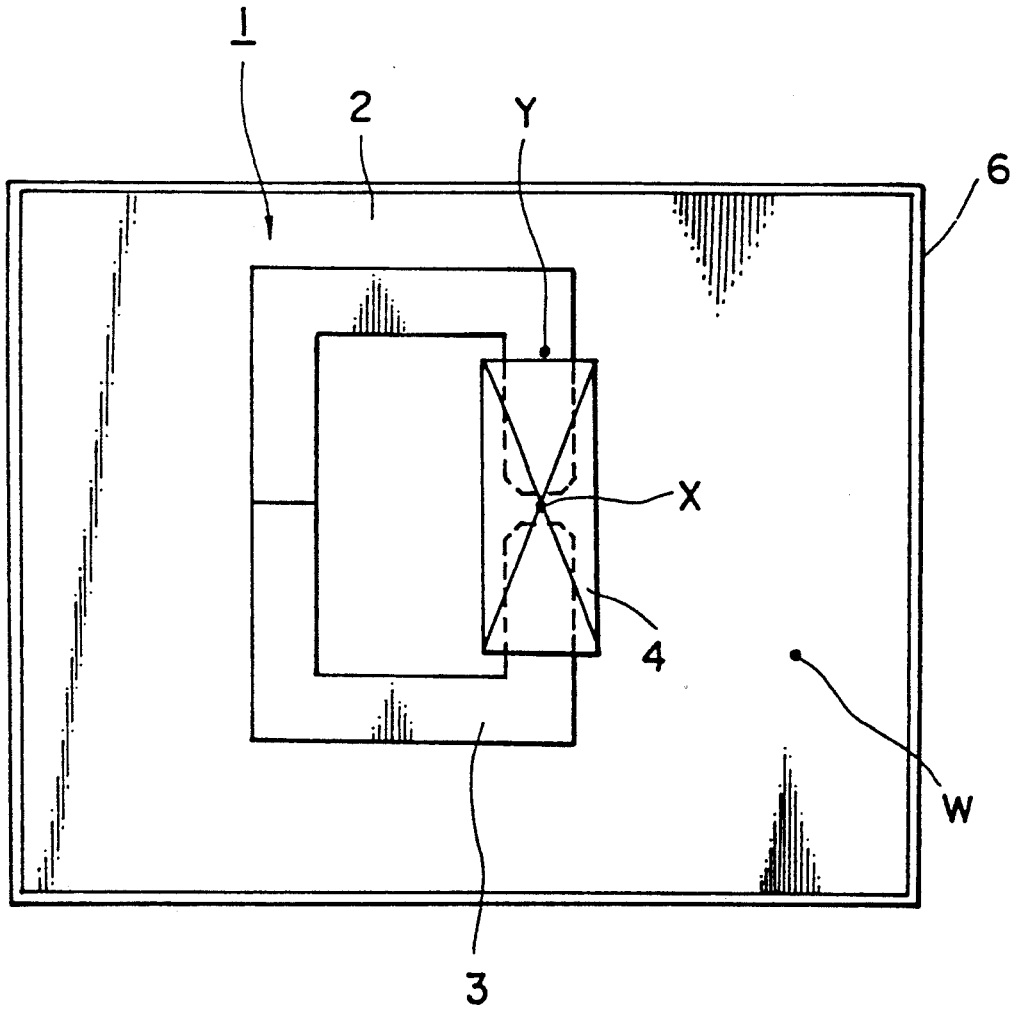
FIG. 14 illustrates how temperatures are detected in individual portions of the coil device according to the present invention.

Table 1 shown below is a list of experimental results obtained by using a tester 6 of FIG. 14 and detecting the temperatures in coil centers X, coil ends Y, cores Z and peripheries W of coil devices 1 having the opposed ends of the aforementioned shapes (under the testing conditions including a frequency of 100 kHz, a current of 0.8 A, sine wave and ambient temperature of 40° C.). (In this table, the shapes (a) through (f) correspond respectively to the shapes of magnetic cores shown in FIGS. 2 through 7.)

TABLE 1

(°C.)

| Shape | X Coil center | Y Coil end | Z Core | W Periphery |
|---|---|---|---|---|
| (a) | 101.5 | 81.0 | 67.5 | 51.0 |
| (b) | 96.5 | 78.0 | 66.0 | 48.5 |
| (c) | 89.5 | 73.5 | 62.0 | 47.5 |
| (d) | 81.5 | 69.5 | 58.0 | 46.5 |
| (e) | 85.5 | 69.0 | 57.5 | 45.5 |
| (f) | 82.0 | 70.5 | 58.5 | 45.5 |

In comparison with the known shape of FIG. 2, the shapes in the embodiments of the present invention shown in FIGS. 3 through 7 are so improved that, as listed in Table 1, the temperature in the coil center X is lowered by 5° to 20° C.; the temperature in the coil end Y is lower by 3+ to 12° C. the temperature in the core Z is lower by 1.5° to 10° C.; and the temperature in the periphery W is lower by 2.5° to 5.5° C. In the shape of FIG. 7, the saturation magnetic flux density is retained at a relatively high value, and the temperatures in the individual portions are lower due to the insertion of a core member 5*a* which is composed of the same material as that of the magnetic core.

Judging from the above results in combination with the machining facility and the production cost, it is obvious that the embodiments of the present invention are superior to the known one, and the shape of FIG. 5 is considered to be the best of the entire embodiments.

Thus, according to the exemplary embodiments described in detail above, it will be understood that the present invention is structurally simple and ensures satisfactory linearity in the B-H curve with another advantage of preventing abnormal generation of heat that may be caused in the coil around the gap by some leakage magnetic flux.

Figure 15:
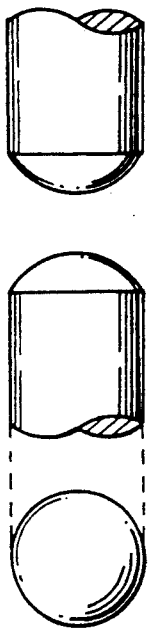
FIGS. 15 through 25 are schematic diagrams illustrating modifications of the gap in the magnetic cores used in the coil device of the present invention.
Figure 16:
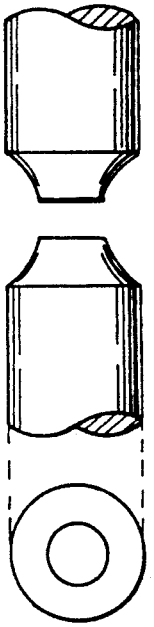
Figure 17:
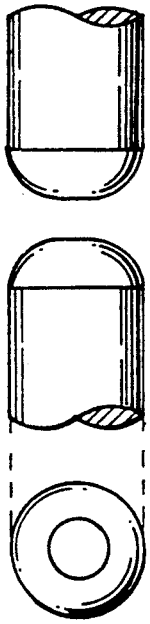
Figure 18:
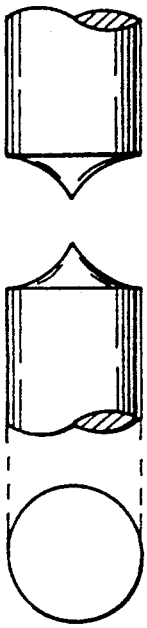
Figure 19:
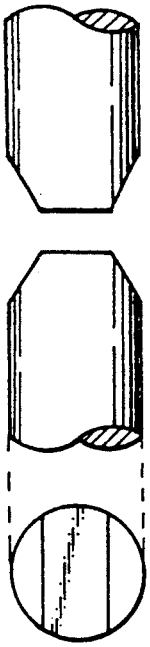
Figure 20:
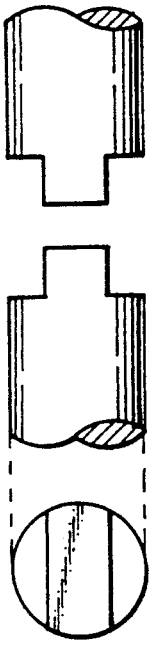
Figure 21:
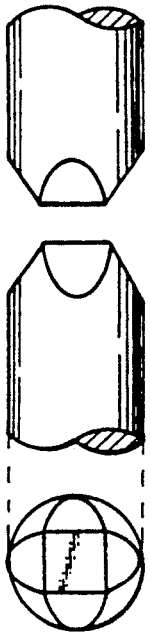
Figure 22:
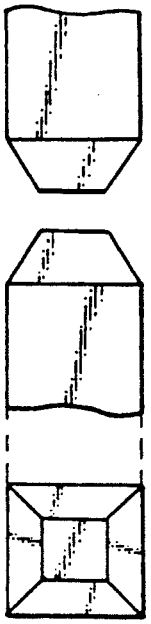

The present invention is not limited to the above embodiments alone, and a variety of modifications may be contrived as well, For example, a gap filler of a suitable material free from exerting any harmful influence on the magnetic permeability $\mu$ may be inserted in the gap, and the gap may be formed between some other legs than the center legs. As for the shape of the opposed ends, similar effects can be achieved in modified ones as well as in the exemplary shapes of the aforementioned embodiments on condition that the sectional area is reduced toward the opposed faces. Typical modifications include a curved shape shown in FIG. 15; a shape of FIG. 16 where the sectional area is reduced with curved surfaces toward the opposed end faces; a bowl-like shape shown in FIG. 17; a pointed shape shown in FIG. 18; a shape of FIG. 19 where two edges are cut off obliquely; a shape of FIG. 20 where two edges are cut off rectangularly; a shape of FIG. 21 where the top surface of the truncated cone is square; and a truncated pyramid shown in FIG. 22. Although each of the above embodiments is concerned with a device having two closed magnetic paths, the present invention is applicable also to any device with one, three or more closed magnetic paths. It is a matter of course that the invention can be carried into effect in any other coil device than the aforementioned embodiments.

In each of the embodiments described, equivalent effects are attainable if, with regard to the mutually opposed core portions in the region to form a gap, the rate of the cross-sectional area of the fore end to that of the base end is within a range of 1 to 90 percent.

Figure 23:
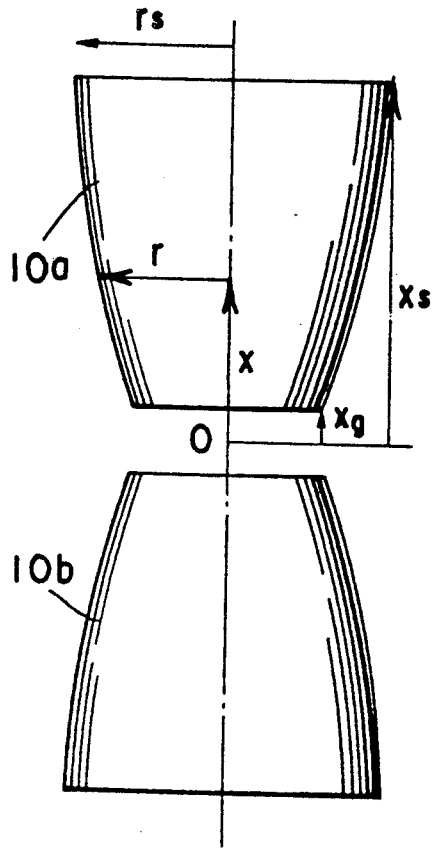

In addition, if the fore ends of the magnetic cores 10*a*, 10*b* are so curved as defined by logarithmic functions, as illustrated in FIG. 23, then the characteristics can further be enhanced when such magnetic cores are employed in the coil device. The curves of such fore end shape are expressed by the following logarithmic functions:

$$\gamma S - \gamma = X_g l_n \frac{X_S}{X}$$

Figure 24:
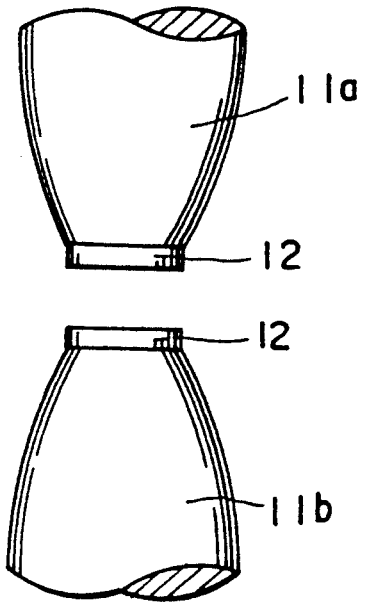

When the fore ends of magnetic cores 11*a*, 11*b* are furnished with planar members 12, 12 as illustrated in FIG. 24, remarkable convenience is achieved since the areas of the fore end faces remain unchanged in adjusting the gap there between by partially grinding the planar faces of such members in parallel with each other.

Figure 25:
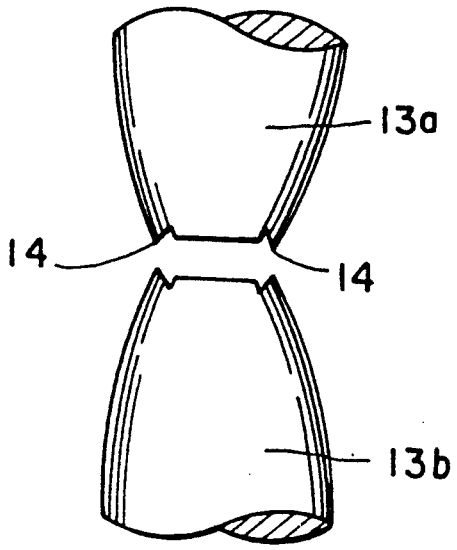

In another example where projections 14, 14 are formed on the faces of for ends of magnetic cores 13*a*, 13*b* as illustrated in FIG. 25, there is attainable an advantage of rendering the flux density uniform in the gap and reducing the leakage flux that interlinks with the coil.

What is claimed is:

1. A coil device comprising:

two magnetic cores each being U-shaped in section and having first and second legs, the first leg being longer than the second leg, said two magnetic cores being positioned so as to form a magnetic path therein with the first and second legs of one of said two magnetic cores being mutually opposed to the first and second legs, respectively, of the other of said two magnetic cores, the mutually opposed second legs forming a gap in the magnetic path, each of the second legs being formed such that a fore end of each of the second legs is tapered from a base end to a center of the fore end to become narrow according to a logarithmic curve represented by the equation:

$$r_s - r = x_g \log_e(x_s/x)$$

where $x_g$ is a distance from a center of the gap to a surface of the fore end of one of the second legs, $x_s$ is a distance from the center of the gap to the base end of the one second leg, x is a distance from an origin of coordinates of an x-axis along a longitudinal centerline of the second legs wherein the origin is the center of the gap, r is a radius of the base end of the one second leg, and r is a radius of the one second leg relative to x along the x-axis; and a coil wound so as to cover the gap, wherein mutually opposed portions of the mutually opposed second legs of said magnetic cores to form the gap are completely enclosed by said coil.

2. A coil device according to claim 1, wherein the mutually opposed portions of the second legs forming the gap are formed such that a ratio of the cross-sectional area of the fore end to that of the base end is within a range of 1 to 90 percent.

3. A coil device according to claim 1, wherein a member having a planar surface is provided on the fore end.

4. A coil device according to claim 1, wherein projections are formed on a face of the fore end.

5. A coil device having first and second magnetic cores each having a first leg formed longer than a second leg, the first legs of said first and second cores being positioned with each other and the second legs being positioned with each other, respectively, in opposing relationship so as to form a gap between opposing surfaces of the second legs, a coil being wound so as to enclose the gap completely, the improvement comprising:

each of the second legs forming the gap and opposed from each other being formed such that a fore end of each of the second legs is tapered from the base end to a center of the fore end to become narrow according to a logarithmic curve represented by the equation:

$$r_s - r = x_b \log_e(x_s/x)$$

where $x_g$ is a distance from a center of the gap to a surface of the fore end of one of the second legs, $x_s$ is the distance from the center of the gap to the base end of the one second leg, x is a distance from an origin of coordinates of an x-axis along a longitudinal centerline of the second legs wherein the origin is the center of the gap, $r_s$ is a radius of the base end of the one second leg, and r is a radius of the one second leg relative to x along the x-axis.

6. The improvement of a coil device according to claim 5, wherein the second legs forming the gap are formed such that a ratio of the cross-sectional area of the fore end to that of the base end is within a range of 1 to 90 percent.

7. The improvement of a coil device according to claim 5, wherein a member having a planar surface is provided on the fore end.

8. The improvement of a coil device according to claim wherein projections are formed on a face of the fore end.

* * * * *